US006637176B1

(12) United States Patent
Krall

(10) Patent No.: US 6,637,176 B1
(45) Date of Patent: Oct. 28, 2003

(54) CONTAINER AND CLOSURE PACKAGE AND A METHOD OF FILLING

(75) Inventor: Thomas J. Krall, Toledo, OH (US)

(73) Assignee: Owens-Brockway Plastic Products Inc., Toledo, OH (US)

( * ) Notice: Subject to any disclaimer, the term of this patent is extended or adjusted under 35 U.S.C. 154(b) by 0 days.

(21) Appl. No.: 10/284,818

(22) Filed: Oct. 31, 2002

Related U.S. Application Data

(60) Division of application No. 09/902,044, filed on Jul. 10, 2001, now Pat. No. 6,508,375, which is a continuation-in-part of application No. 09/468,576, filed on Dec. 21, 1999, now Pat. No. 6,279,789.

(51) Int. Cl.[7] ..... B65B 7/28
(52) U.S. Cl. ..... 53/420; 53/471
(58) Field of Search ..... 53/420, 471, 478, 53/421, 329.3; 220/359.1, 359.3, 359.4, 361, 363, 254.1; 215/232, 274

(56) References Cited

U.S. PATENT DOCUMENTS

| | | | | | |
|---|---|---|---|---|---|
| 1,773,311 | A | | 8/1930 | Killen | |
| 2,046,227 | A | | 6/1936 | White | |
| 2,108,114 | A | * | 2/1938 | Foard | 53/471 |
| 2,416,900 | A | | 3/1947 | Busby | |
| 2,819,812 | A | | 1/1958 | Freundorfer | |
| 3,325,033 | A | | 6/1967 | Wheaton | |
| 3,488,201 | A | | 1/1970 | Pizarro | |
| 3,494,093 | A | * | 2/1970 | Downs | 53/471 |
| 4,109,815 | A | | 8/1978 | Collins, III | |
| 4,240,242 | A | | 12/1980 | Sullivan et al. | |
| 4,258,529 | A | * | 3/1981 | Smith | 53/478 |
| 4,586,622 | A | | 5/1986 | Walldorf | |
| 4,599,851 | A | * | 7/1986 | Williams | 53/471 |
| 4,700,857 | A | | 10/1987 | Kittscher | |
| 4,926,613 | A | | 5/1990 | Hansen | |
| 5,125,528 | A | | 6/1992 | Heyn et al. | |
| 5,226,281 | A | * | 7/1993 | Han et al. | 53/478 |
| 5,240,131 | A | | 8/1993 | Keller | |
| 5,244,117 | A | * | 9/1993 | Lombardo | 53/470 |
| 5,246,134 | A | | 9/1993 | Roth et al. | |
| 5,255,492 | A | | 10/1993 | Larson | |
| 5,273,416 | A | | 12/1993 | Heyn et al. | |
| 5,395,005 | A | | 3/1995 | Yoshida | |
| 5,634,567 | A | | 6/1997 | Hekal | |
| 5,660,290 | A | | 8/1997 | Hayes | |
| 5,688,544 | A | | 11/1997 | Bolton et al. | |
| 5,904,259 | A | | 5/1999 | Hidding et al. | |
| 6,102,236 | A | | 8/2000 | Ohisson et al. | |
| 6,258,312 | B1 | | 7/2001 | Heyn | |
| 6,279,789 | B1 | | 8/2001 | Krall | |

* cited by examiner

*Primary Examiner*—John Sipos

(57) ABSTRACT

A container and closure package includes a container having a body with a finish surrounding a fill/dispensing opening, and a closure having a peripheral skirt removably secured to the container finish. The closure has a base wall with a fill opening aligned with the fill/dispensing opening in the container when the closure is secured to the container and a recessed ledge surrounding the fill opening. A seal is provided at the underside of the base wall in sealing engagement with the fill/dispensing opening of the container. A disk has an electrically conductive underlayer that is induction fusion welded to the closure.

7 Claims, 1 Drawing Sheet

CONTAINER AND CLOSURE PACKAGE AND A METHOD OF FILLING

This application is a division of application Ser. No. 09/902,044 filed Jul. 10, 2001, now U.S. Pat. No. 6,508,375, which is acontinuation-part of application Ser. No. 09/468, 576 filed Dec. 21, 1999 now U.S. Pat. No. 6,279,789, disclosure of which is incorporated herein by reference.

The present invention is directed to product containment and dispensing packages, and to methods of filling the packages with product and then closing the packages after filling. The invention is directed more particularly to a package and method of the described character that are particularly well suited for hot-fill and retort applications.

BACKGROUND AND SUMMARY OF THE INVENTION

Product containment and dispensing packages conventionally include a container having a fill/dispensing opening, and a closure threadably secured to the container finish closing the fill/dispensing opening. In the manufacture and filling of packages of this type, the containers and closures are typically shipped separately to a product packager, perhaps by different suppliers. The containers are filled with product by the packager in an automated or manual filling operation, and the closures are then applied to the containers, again either automatically or manually, to complete the packages. The closures may alternatively be applied to the containers when the containers and closures are supplied to the packager. This alternative reduces inventory at the packager, but requires the extra step of removing the closure prior to filling the container, followed by reapplication of the closure after filling.

It is a general object of the present invention to provide a container and closure package, and a method of filling such a package, that address one or more of the following objectives: reducing costs associated with handling and filling of containers at the packaging facility by providing a container and closure package that can be filled and closed at increased speed, using less equipment and less labor; reducing or eliminating leakage of product around the container finish; accommodating addition of promotional information or the like on the container package without requiring re-tooling of the container or closure; affecting a seal between the container and the closure prior to filling; utilizing a barrier material to reduce permeation of gases, such as carbon dioxide and oxygen, water vapor or flavorants of food products, through the closure; and/or using deformation of the closure seal to indicate presence of a vacuum in the package.

A container and closure package in accordance with presently preferred embodiments of the invention includes a container having a body with a finish surrounding a fill/dispensing opening, and a closure having a peripheral skirt removably secured to the container finish. The closure has a base wall with a fill opening aligned with the fill/dispensing opening in the container when the closure is secured to the container, and a recessed ledge surrounding the fill opening. A seal is provided at the underside of the base wall in sealing engagement with the fill/dispensing opening of the container. A disk, which closes the fill opening of the closure, has an electrically conductive layer and is induction or conduction fusion welded to the ledge.

In the disclosed embodiments of the invention, the seal between the underside of the closure and the fill/dispensing opening in the container may include an annular gasket captured between the edge of the container finish and the underside of the closure base wall, which may be secured to the closure base wall, or an annular wall depending from the base wall and spaced radially inwardly from the closure skirt for internal plug-sealing engagement with an inside diameter of the fill/dispensing opening in the container. The disk over the closure fill opening is preferably of laminated construction, having an under layer of plastic and an electrically conductive layer adjacent to the underlayer for induction or conduction heating the underlayer and melt-fusion bonding the underlayer to the ledge. Other layers of the disk may include one or more barrier materials to prevent migration of gases (e.g., oxygen or carbon dioxide), water vapor and/or flavorants through the disk. Upper layers of the disk may be provided with advertising or promotional information, which may be readily changed without re-tooling the entire closure. The disk is preferably of uniform thickness and sufficiently flexible that the disk flexes axially inwardly with respect to the base wall to indicate presence of a vacuum in the package.

A method of filling a container and closure package in accordance with another aspect of the invention includes providing a container having a body with a finish surrounding a fill/dispensing opening and a closure removably secured to the finish. The closure has a base wall with a fill opening aligned with the fill/dispensing opening in the container, and a recessed ledge surrounding the fill opening. The container is filled with product through the fill opening in the closure and the fill/dispensing opening in the container, and a disk is then non-removably secured against the recessed ledge of the closure to seal the package. In the preferred embodiments of the invention, the disk is non-removably secured to the recessed ledge by fusion welding, preferably by providing an electrically conductive layer on the disk and induction or conduction welding the disk to the ledge on the closure.

BRIEF DESCRIPTION OF THE DRAWINGS

The invention, together with additional objects, features and advantages thereof, will be best understood from the following description, the appended claims and the accompanying drawing, in which:

DETAILED DESCRIPTION OF PREFERRED EMBODIMENTS

Figure 1:
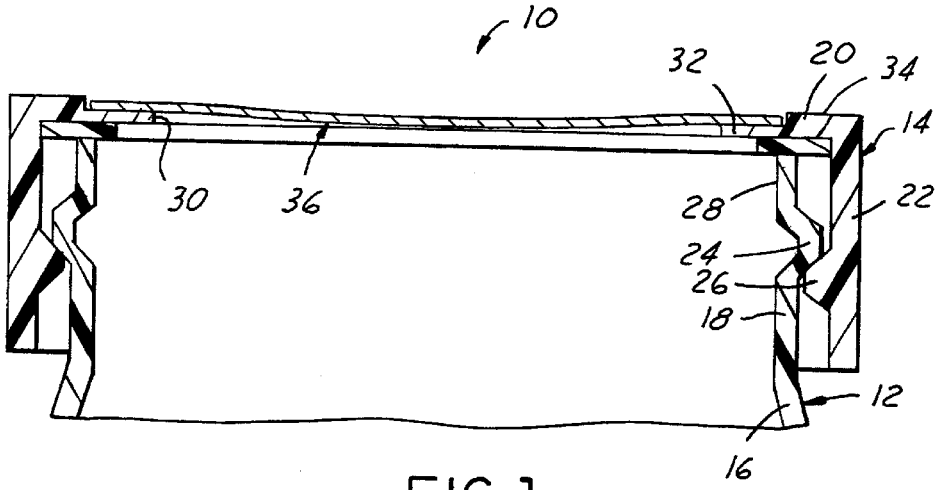
FIG. 1 is a fragmentary sectional view diametrically bisecting a container and closure package in accordance with one presently preferred embodiment of the invention.
Figure 2:
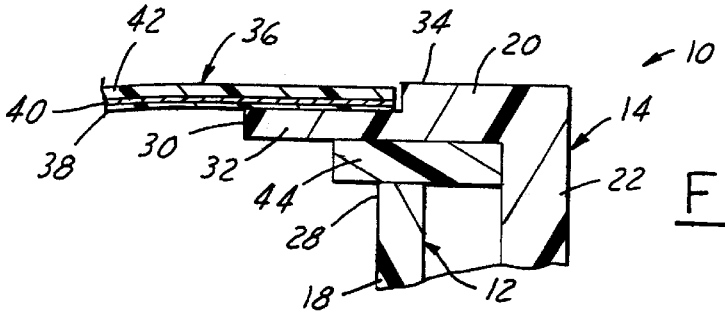
FIG. 2 is a fragmentary sectional view on an enlarged scale of a portion of the package illustrated in FIG. 1.

FIGS. 1 and 2 illustrates a container and closure package 10 in accordance with one presently preferred embodiment of the invention as comprising a container 12 and a closure 14. Container 12 has a body 16 with an axial extending substantially cylindrical finish 18 to which closure 14 is secured. Closure 14 includes a flat circular base wall 20 and an axially extended peripheral skirt 22. Closure 14 is secured to container finish 18 by means of an external thread or bead 24 on finish 18 cooperating with an internal thread or bead 26 on peripheral skirt 22. Container finish 18 defines a circular mouth 28 that forms a fill/dispensing opening for container 12. Disk base wall 20 has a central substantially circular fill opening 30 that aligns in assembly with container fill/dispensing opening 28. Closure fill opening 30 is surrounded by an axially facing circular ledge 32 that is recessed with respect to the outer surface 34 of closure base wall 20.

A disk 36 is non-removably secured to base wall 20 of closure 14, preferably by being fusion welded or bonded to the axially outwardly facing surface of ledge 32. Disk 36 is preferably circular and of uniform thickness, and is substantially flat prior to assembly to the closure. As best seen in FIG. 2, disk 36 is a laminated structure that includes an electrically conductive layer adapted to the induction or conduction fusion bonded to ledge 32 of closure 14. In the embodiment illustrated in FIG. 2, disk 36 includes an underlayer 38 of plastic construction, and a layer 40 of electrically conductive material such as metal foil or metal-doped plastic. A base layer 42 overlies electrically conductive layer 40. An annular resilient gasket 44 is captured in sealing compression between the underside of base wall 20 beneath ledge 32 and the axial edge of container finish 18 surrounding fill/dispensing opening 28. Gasket 44 is preferably secured to the underside of closure base wall 20, either by being separately formed and adhered to the underside of the base wall, or by being compression molded in situ on the underside of the base wall.

Figure 3:
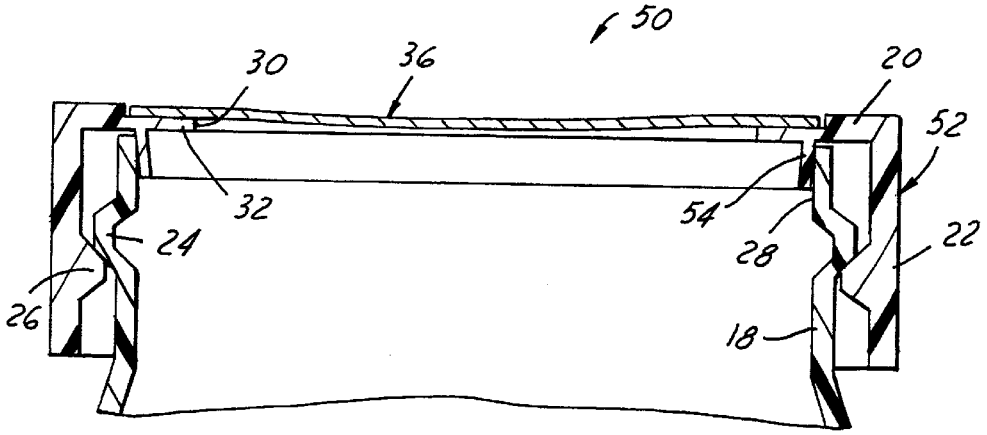
FIG. 3 is a fragmentary sectional view similar to that of FIG. 1 but illustrating a modified embodiment of the invention.

FIG. 3 illustrates a closure and container package 50 in accordance with a modified embodiment of the invention as comprising container 12 and a modified closure 52. In closure 52, annular sealing gasket 44 (FIGS. 1–2) is replaced by an annular plug-seal wall 54 that integrally depends from closure base wall 20 beneath ledge 32. Wall 54 is circumferentially continuous, and is spaced radially inwardly from peripheral skirt 22 by an amount sufficient for press-fit plug-sealing engagement with container fill/dispensing opening 28 around the inside diameter of the container finish.

Container 12 is preferably of blow molded plastic construction, with the container finish being either blow molded simultaneously with the container body or injection molded prior to blow molding the container body. Closure 14 is preferably of compression molded or injection molded plastic construction. Disk 36 may be fabricated employing any suitable technique, such as by coextrusion or by adhesion of separately fabricated layers. Disk 36 is initially flat as well as circular. The subassembly of container 12 and closure 14 or 52 can be bulk palletized or placed into cases, and shipped to a packaging customer for filling. The bulk palletized or cased containers are filled through the open tops of the closures and through the fill/dispensing openings of the containers. A disk 36 is then applied over each closure fill opening against ledge 32. Disk 36 is induction or conduction fusion bonded to closure ledge 32 by conventional induction techniques, inducing a current in electrically conductive layer 40 that melts plastic layer 38 and fusion bonds plastic layer 38 to closure ledge 32. Outer or base layer 42 may be of a plastic having a higher melt temperature than underlayer 38, or of other suitable material. Disk 36 is thus non-removably fusion welded to closure 14 or 52 to seal the completed and filled package. There is no leakage of product on the thread or bead of the container finish, which can adversely affect removal. The filling operation can be completed more quickly using less equipment and less labor as compared with conventional filling and capping techniques. The thickness of disk 36 is preferably coordinated with the recess of ledge 32 so that the upper surface of the disk is either flush with or disposed beneath outer surface 34 of closure base wall 20.

The closure and container package may be hot-filled with liquid product such as juice, and disk 36 applied and fusion bonded to the closure while the contents are still hot. In other applications, the contents of the sealed container may be subjected to retort heat after packaging. In either case, cooling of the product creates a reduced pressure or vacuum within the sealed container, causing disk 36 to flex or bow axially inwardly as shown in the drawings, which will indicate to a purchaser that the package has not been unsealed. Outer layer 42 may comprise, or may include a sub-layer that comprises, a barrier material such as EVOH.

There have thus been disclosed a container and closure package, and a method of filling such a package, that fully achieve one or more of the objects and aims previously set forth. Several modifications and variations have been disclosed. Other modifications and variations will readily suggest themselves to persons of ordinary skill in the art in view of the foregoing description. The invention is intended to embrace all such modifications and variations that fall within the spirt and broad scope of the appended claims.

What is claimed is:

1. The method of filling a container and closure package, which comprises the steps of:

(a) providing a container having a body with a finish surrounding a fill/dispensing opening and a closure removably secured to said finish, said closure having a base wall with a fill opening aligned with said fill/dispensing opening in said container and a recessed ledge surrounding said fill opening, (b) filling the container with product through said fill opening in said closure base wall and said fill/dispensing opening in said container, and then (c) non-removably securing a disk against said recessed ledge covering and closing said opening in said closure base wall.

2. The method set forth in claim 1 wherein said step (c) is carried out by providing an electrically conductive underlayer in said disk, and induction welding said disk to said ledge.

3. The method set forth in claim 1 wherein said step (b) comprises the step of filling the container with hot liquid product.

4. The method set forth in claim 3 wherein said disk is flexible and is adapted to flex inwardly with respect to said base wall to indicate presence of a vacuum in the package.

5. The method set forth in claim 1 comprising the additional step of: (d) retorting said package after said step (c).

6. The method set forth in claim 1 wherein said disk is of laminated construction, including at least one layer of barrier resin material.

7. The method set forth in claim 1 wherein said disk is of laminated construction, having an underlayer of plastic and an electrically conducive layer adjacent to said underlayer for induction heating said underlayer and melt-fusion bonding said underlayer to said ledge.

* * * * *